US011761130B2

(12) United States Patent
Noelle et al.

(10) Patent No.: US 11,761,130 B2
(45) Date of Patent: Sep. 19, 2023

(54) SYSTEM FOR THE BONDING OF AT LEAST ONE WET-LAID OR DRY-LAID FIBER LAYER

(71) Applicant: ANDRITZ KUESTERS GMBH, Krefeld (DE)

(72) Inventors: Frederic Noelle, Saint Nazaire les Eymes (FR); Dennis Latendorf, Krefeld (DE)

(73) Assignee: ANDRITZ KUESTERS GMBH, Krefeld (DE)

( * ) Notice: Subject to any disclaimer, the term of this patent is extended or adjusted under 35 U.S.C. 154(b) by 0 days.

(21) Appl. No.: 17/700,529

(22) Filed: Mar. 22, 2022

(65) Prior Publication Data

US 2022/0307173 A1 Sep. 29, 2022

(30) Foreign Application Priority Data

Mar. 29, 2021 (DE) ..... 10 2021 107 902.0

(51) Int. Cl.
*D04H 18/04* (2012.01)
*D04H 1/492* (2012.01)

(52) U.S. Cl.
CPC ..... *D04H 18/04* (2013.01); *D04H 1/492* (2013.01)

(58) Field of Classification Search
CPC ..... D04H 18/04; D04H 1/465; D04H 1/49; D04H 1/485; D04H 1/492; D04H 1/498; D04H 3/11; D04H 5/03; D04H 1/732; D04H 1/74; D04H 1/488; D04H 1/54; D04H 1/58; D04H 1/558; D04H 5/02; D04H 5/06; D04H 18/00; D04H 18/02; D04H 1/46; D04H 1/495; D04H 1/559; D04H 1/56; D04H 1/593; D04H 3/08; D04H 3/10; D04H 3/12; D04H 3/14; D04H 13/003; D04H 13/007; B32B 38/00; B32B 2038/0052
USPC ..... 28/104, 105
See application file for complete search history.

(56) References Cited

U.S. PATENT DOCUMENTS 3,042,576 A * 7/1962 Harmon ..... D04H 1/495 162/114
5,718,022 A * 2/1998 Vuillaume ..... D04H 18/04 28/104
5,761,778 A * 6/1998 Fleissner ..... D04H 1/46 28/104

(Continued)

FOREIGN PATENT DOCUMENTS

DE 600 30 120 T2 2/2007
DE 10 2013 107 237 A1 1/2015

(Continued)

*Primary Examiner* — Amy Vanatta
(74) *Attorney, Agent, or Firm* — Norman B. Thot

(57) ABSTRACT

A system for bonding at least one wet-laid or dry-laid fiber layer to form a nonwoven web. The system includes a conveyor having a circulating belt which has an upper strand arranged so that the at least one wet-laid or dry-laid fiber layer is deposited and displaced on the upper strand in a production direction, a first bonding device which bonds the at least one wet-laid or dry-laid fiber layer when on the upper strand, a second bonding device arranged so that the at least one wet-laid or dry-laid fiber layer is bonded after leaving the upper strand, and a transfer device which feeds the at least one wet-laid or dry-laid fiber layer to the second bonding device.

11 Claims, 6 Drawing Sheets

(56) References Cited

U.S. PATENT DOCUMENTS

| | | | | |
|---|---|---|---|---|
| 2002/0157766 | A1 | 10/2002 | Vuillaume et al. | |
| 2002/0168910 | A1* | 11/2002 | Vuillaume | D04H 3/153 442/385 |
| 2005/0091811 | A1* | 5/2005 | Billgren | D04H 5/02 28/104 |
| 2006/0080816 | A1* | 4/2006 | Noelle | D04H 1/732 28/104 |
| 2007/0000107 | A1* | 1/2007 | Jeambar | D04H 1/425 162/157.1 |
| 2007/0271749 | A1* | 11/2007 | Noelle | D04H 3/11 28/167 |
| 2008/0045107 | A1* | 2/2008 | Michalon | D04H 1/44 28/104 |
| 2008/0307619 | A1* | 12/2008 | Fechter | D04H 18/04 28/105 |
| 2012/0096694 | A1* | 4/2012 | Muenstermainn | D04H 1/46 28/104 |
| 2018/0112339 | A1 | 4/2018 | Weigert et al. | |
| 2022/0025563 | A1* | 1/2022 | Richter | D04H 18/04 |

FOREIGN PATENT DOCUMENTS

| | | | |
|---|---|---|---|
| WO | WO 2009/112015 | A1 | 9/2009 |
| WO | WO 2016/165798 | A1 | 10/2016 |

* cited by examiner

SYSTEM FOR THE BONDING OF AT LEAST ONE WET-LAID OR DRY-LAID FIBER LAYER

CROSS REFERENCE TO PRIOR APPLICATIONS

Priority is claimed to German Patent Application No. DE 10 2021 107 902.0, filed Mar. 29, 2021. The entire disclosure of said application is incorporated by reference herein.

FIELD

The present invention relates to a system for bonding at least one wet-laid or dry-laid fiber layer to form a nonwoven web, the system having a conveyor that includes a circulating belt with an upper strand on which the at least one fiber layer can be deposited and displaced in a production direction.

BACKGROUND

It is known in the nonwovens industry to hydro-entangle wet-laid or dry-laid layers comprising wood or other fibers, for example, to produce flushable wipes comprising blends of wood pulp and plastics fibers. Systems of this type are in particular used to connect the layers to one another when wet.

It is known in the nonwovens industry to bond wet-laid or dry-laid layers to carded or spun layers by hydro-entanglement to, for example, produce multilayer nonwovens. These systems generally include a conveyor having a bonding device and, downstream in the production direction, a second bonding device having at least two bonding drums with which both sides of the nonwoven web can be bonded. These systems are particularly suitable for achieving an intensive bonding of the layers to one another, resulting in nonwoven webs having high tensile strengths and abrasion resistances.

A disadvantage is, however, the lack of systems that are equally well suited for the production of only weakly bonded nonwoven webs, for example, for the production of flushable wipes, and for the production of strongly bonded nonwoven webs, in particular those having a plurality of layers.

SUMMARY

An aspect of the present invention is to provide a system that is equally well suited for the production of these different nonwoven webs.

In an embodiment, the present invention provides a system for bonding at least one wet-laid or dry-laid fiber layer to form a nonwoven web. The system includes a conveyor comprising a circulating belt which comprises an upper strand which is configured so that the at least one wet-laid or dry-laid fiber layer is deposited and displaced on the upper strand in a production direction, a first bonding device which is configured to bond the at least one wet-laid or dry-laid fiber layer when on the upper strand, a second bonding device which is configured so that the at least one wet-laid or dry-laid fiber layer is bonded after leaving the upper strand, and a transfer device which is configured to feed the at least one wet-laid or dry-laid fiber layer to the second bonding device.

BRIEF DESCRIPTION OF THE DRAWINGS

The present invention is described in greater detail below on the basis of embodiments and of the drawings in which.

DETAILED DESCRIPTION

Figure 1:
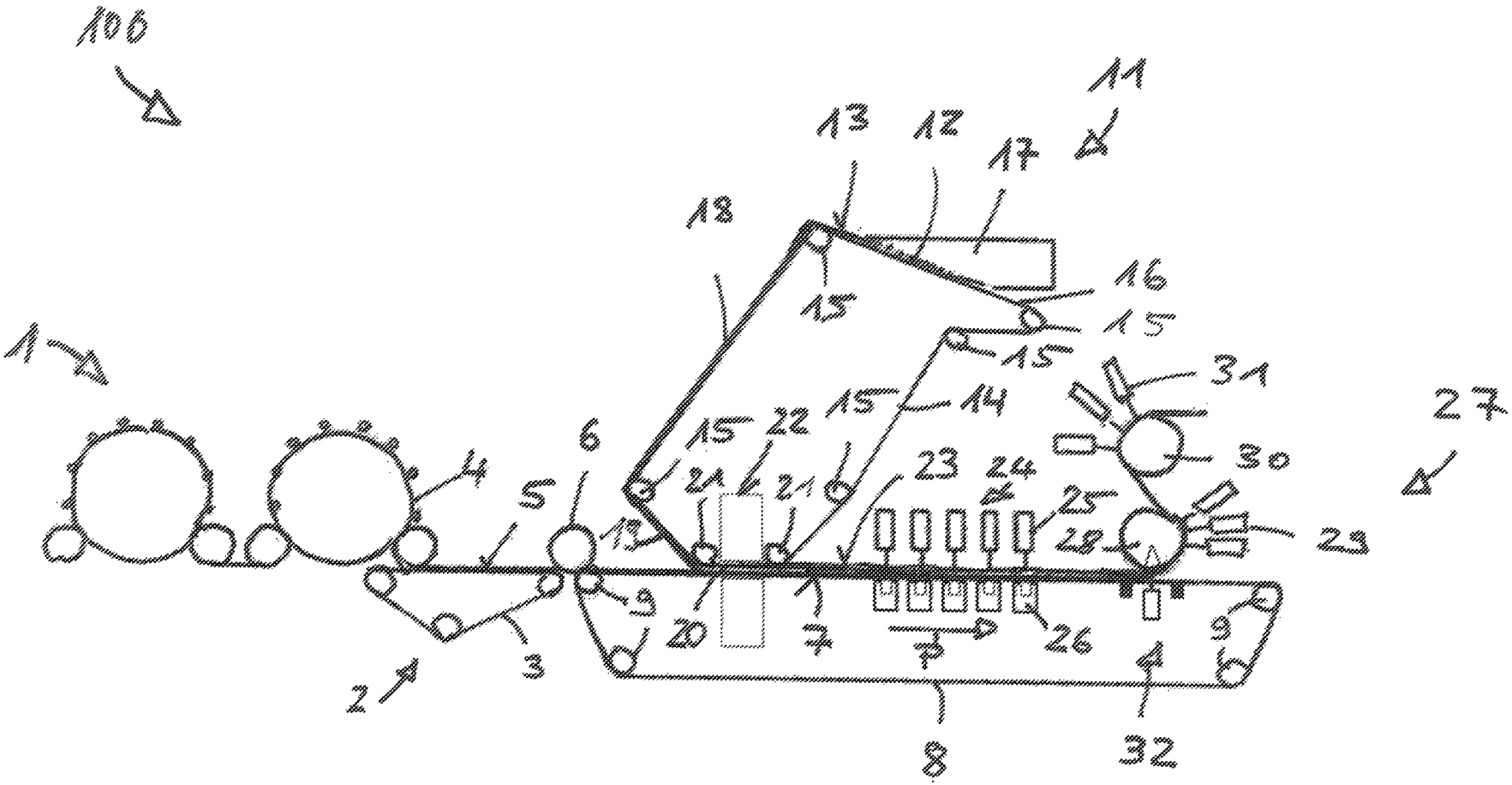
FIG. 1 shows a first embodiment of the system according to the present invention in a first operating state.

The system according to the present invention comprises a first bonding device via which at least one wet-laid or dry-laid fiber layer can be bonded while it is on the upper strand of the circulating belt. The first bonding device is designed so that it also includes, for example, fibers of natural origin, such as wood fibers or viscose, or synthetic fibers or mixtures thereof, for the comparatively minimal bonding of fiber layers.

The system according to the present invention also includes a second bonding device via which a fiber layer can be additionally bonded after leaving the upper strand. The second bonding device is in particular designed so that for bonding, for example, a plurality of layers, which can comprise carded nonwovens or spunbonded nonwovens and also wet-laid or dry-laid fiber layers, the plurality of layers can be connected to one another comparatively firmly.

The system according to the present invention also comprises a transfer device via which the fiber layer can be fed from the upper strand to the second bonding device after the fiber layer has passed through the first bonding device. The term "optionally feedable" means that the system according to the present invention can be operated in a first operating state in which the fiber layer only passes through the first bonding device and, after leaving the upper strand of the conveyor, can be fed to further production steps, bypassing the second bonding device, and a second operating state, in which the fiber layer is fed from the upper strand to the second bonding device and can be fed therefrom to further production steps. The system according to the present invention is thus suitable in the first operating state for producing the weakly bonded nonwoven webs and in the second operating state for producing the strongly bonded nonwoven webs.

The circulating belt of the conveyor can, for example, be designed to be fluid-permeable. The first bonding device can thereby, for example, be designed as a water-jet bonding device in which nozzle bars are arranged above the upper strand, from which nozzle bars water can be sprayed onto the fiber layer from above and, after penetrating the fiber layer and the belt, can be collected below the upper strand, for example, using suction boxes. The transfer device can also include a fluid dispensing device which is arranged below the upper strand via which fluid can be guided from below through the upper strand against the bottom side of the fiber layer in order to be able to lift it from the upper strand of the conveyor and feed it to the second bonding device.

The second bonding device can, for example, comprise a bonding drum which is arranged above the upper strand which has an outer circumference around which the fiber layer can be guided partially so that the top side of the fiber layer rests against the bonding drum. The bonding device may also comprise one or more nozzle bars acting against the region of the bonding drum surrounded by the fiber layer, via which bars fluid can be directed against the bottom side of the fiber layer. The second bonding device can also comprise a further bonding drum having a circumference against which the other side of the fiber layer rests. One or more nozzle bars are in turn provided via which fluid is in turn directed against the other side of the fiber layer, which corresponds to the top side of the fiber layer on the upper strand. The bonding drums can, for example, have fluid-permeable outer surfaces so that fluid dispensed from the bars can be suctioned off therethrough.

Because an embodiment of the system according to the present invention can, for example, have a bonding drum of the second bonding device which is arranged above the upper strand of the conveyor and the circulating belt which is designed to be fluid-permeable, the fiber layer can be fed to the second bonding device simply by having fluid dispensed from the fluid dispensing device drum arranged below the upper strand at such a pressure and in such a quantity per unit time that the fiber layer is lifted from the upper strand and fed to the bonding drum. This effect and an adhesion of the fiber layer to the bonding drum can be assisted by the bonding drum being subjected to a vacuum, which leads to the second layer being suctioned onto the surface of the bonding drum.

The fluid dispensing device can, for example, comprise a nozzle bar having a plurality of nozzles via which the fluid can be dispensed under an overpressure.

In an embodiment of the system according to the present invention, the transfer device can, for example, comprise at least one lifting device via which the upper strand can be raised in the region of the second bonding device. It is thereby possible to reduce the distance between the top side of the upper strand and the bonding drum arranged above it so that the fiber layer comes into position with the bonding drum. It is thereby possible to reduce the pressure with which the fluid must be dispensed from the nozzle bar of the fluid dispensing device, and possibly to take the fluid dispensing device completely out of operation, which can be particularly advantageous in the case of fiber layers having light fibers, because, under the influence of the fluid, they can be detached from the layer.

In an embodiment of the present invention, the lifting device can, for example, comprise at least one lifting roller and/or a lifting beam. The lifting beam can, for example, have friction-reducing plastics caps or a friction-reducing coating.

In an embodiment of the present invention, at least one lifting roller and/or one lifting beam can, for example, be arranged in the production direction upstream of the fluid dispensing device and at least one lifting roller and/or one lifting beam can, for example, be arranged downstream of the fluid dispensing device. The upper strand of the circulating belt can then be raised over a longer region, as viewed in the production direction, so that the fiber layer rests approximately tangentially against the bonding drum in the region where the fluid dispensing device is active.

In an embodiment, the present invention provides that the lifting devices can, for example, be operatively connected to the fluid dispensing device so that both devices can be raised and lowered synchronously. Lifting and lowering the upper strand does not thereby lead to an increase in the distance from the fluid dispensing device, which means that its effect is not influenced by the lifting or lowering processes.

The lifting and/or the fluid dispensing devices can, for example, be raised and lowered via at least one mechanically, electrically, pneumatically or hydraulically actuated actuator.

The drawing shows (purely schematically and in extracts) embodiments of the device according to the present invention and two different operating states of the device according to the present invention.

The embodiment of a system 100 according to the present invention shown in FIG. 1 comprises a carding unit 1 with which a layer 5 of long fibers 4, which in particular can have fiber lengths of between 10 mm and 150 mm, can be produced. The carding unit 1 comprises a circulating deposit belt 2 having an upper strand 3 on which the long fibers can be deposited in the form of a layer 5 comprising the long fibers 4.

The system 100 also includes a suction roller 6 with which the layer 5 can be transferred to an upper strand 7 of a first belt 8 circulating around rollers 9 in a clockwise direction. The upper strand 7 moves in the direction of the arrow shown in the drawings, which thus symbolizes the production direction P.

The first belt 8 is designed to be permeable to fluids, for example, permeable to liquids and gases, such as a screen belt.

The system 100 also includes a device 11 for providing a layer 13 comprising short fibers 12. The device 11 comprises a second belt 14 which circulates counterclockwise around rollers 15 for this purpose.

The second circulating belt is in turn designed to be fluid-permeable, in particular liquid- and gas-permeable, for example, as a screen belt. The arrangement of the rollers 15 forms a region 16 that ascends, as viewed in the direction of rotation, and in which the short fibers 12 are deposited from a headbox 17, for example, as an aqueous emulsion, to form the layer 13. The short fibers can in particular have lengths of less than 1 mm to 10 mm.

The layer 13 comprising short fibers 12 reaches a lower strand 20 of the second belt 14 via regions 18, 19 which slope downward in relation to the direction of circulation. The lower strand 20 is formed between two lower rollers 21. A pre-bonding unit 22 can be provided in the region of the lower strand 20 with which the layers 5 can be pre-bonded to form a fiber layer 23. The two lower rollers 21 can be part of the pre-bonding unit 22.

A first bonding device 24 is provided downstream of the lower strand 20 in the production direction via which first bonding device 24 the fiber layer 23 can be bonded while the fiber layer 23 is on the upper strand 7 of the first belt 8. In the shown embodiment, the first bonding device 24 comprises a plurality of nozzle bars 25 which are arranged above the upper strand 7, via which nozzle bars 25 fluid, in particular fine water jets, can be applied to the fiber layer 23 so that the fiber layer 23 is bonded by swirling the fibers. Suction chambers 26 are arranged below the upper strand 7 with which suction chambers 27 fluid, in particular water that has penetrated through the fiber layer 23 and the upper strand 7, can be suctioned off under vacuum.

A second bonding device 27 is arranged downstream of the first bonding device 24 in the production direction P. The second bonding device 27 comprises a lower bonding drum 28, a plurality of first nozzle bars 29 via which fluid can be directed against the outer circumference of the lower bonding drum 28, an upper bonding drum 30, and a plurality of second nozzle bars 31 via which fluid can be directed against the circumference of the upper bonding drum 30. The fiber layer 23 can additionally be bonded with the second bonding device 27.

A transfer device 32 is provided under the upper strand 7 below the lower bonding drum 28 via which transfer device 32 the fiber layer 23 can optionally be fed to the second bonding device 27. The system 100 is in its first operating state if this is the case.

In this first operating state, the system 100 is in particular used to intensively bond a fiber layer (both the layer 5 provided by the carding unit 1 and the layer provided by the headbox 17 via the second belt 14) in that the fiber layer is pressurized with fluid during the circulation of the lower and upper bonding drums 28, 30.

Figure 2:
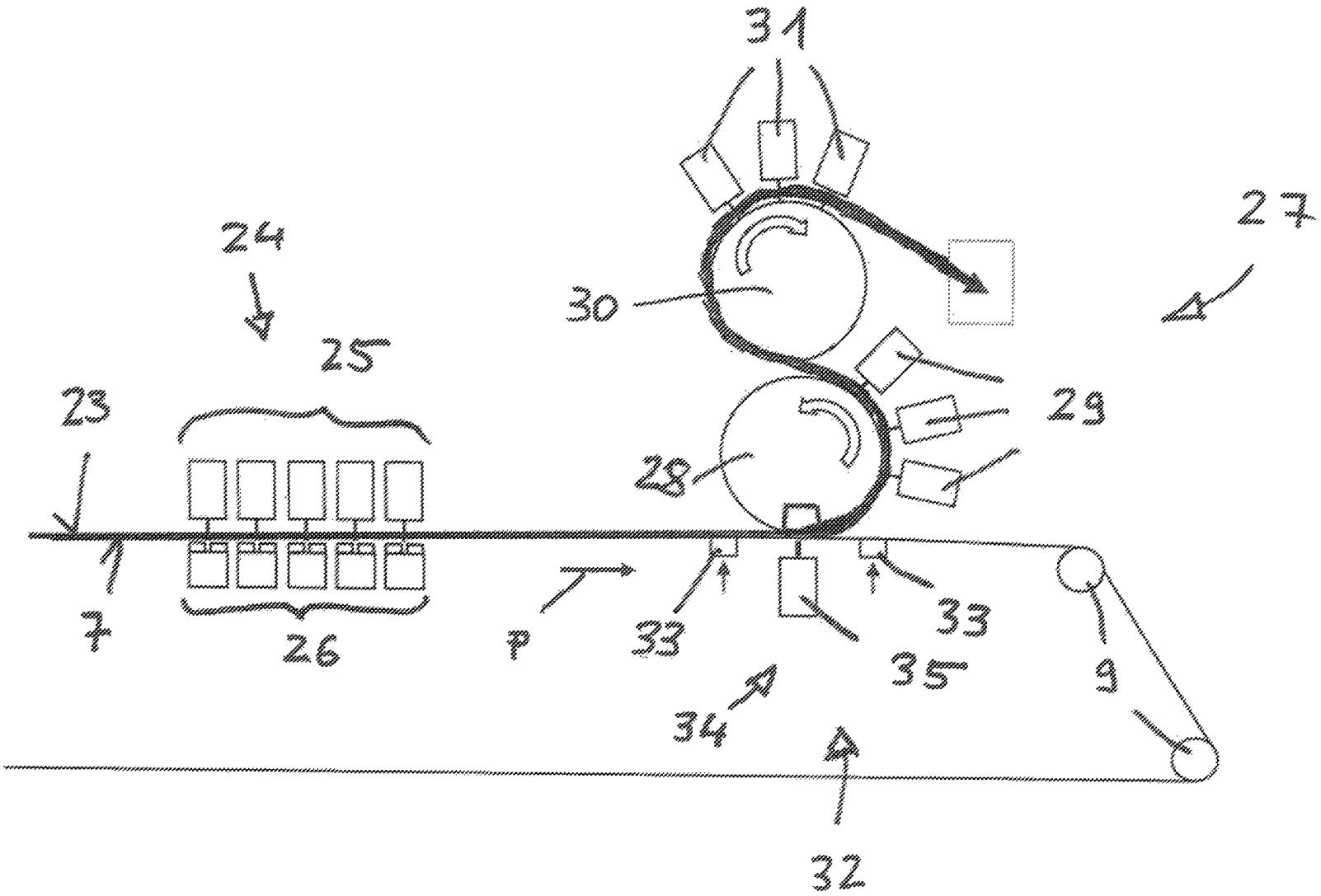
FIG. 2 shows the detail II in FIG. 1 in an enlarged view.

As can in particular be seen in FIG. 2, the transfer device 32 in this embodiment comprises two lifting beams 33 which are spaced apart from one another in the production direction P via which the upper strand 7 in the region of the second bonding device 27 can be raised. The two lifting beams 33 can have friction-reducing plastics caps or a friction-reducing coating in order to reduce the wear caused by contact of the circulating first belt 8.

A fluid dispensing device 34 is arranged between the two lifting beams 33 as viewed in the production direction P, the fluid dispensing device 34 comprising a nozzle bar 35 via which fluid can be dispensed upward under an overpressure. In the first operating state shown in FIG. 2, the two lifting beams 33 are in a raised position in which the distance between the upper strand 7 and the lower bonding drum 28 is reduced so that the fiber layer 23, under the additional effect of the fluid dispensed from the nozzle bar 35, comes into contact with and follows the circumference of the lower bonding drum 28 over an angle of almost 180° and thereafter follows the circumference of the upper bonding drum over an angle of around 180°. The transfer of the fiber layer 23 from the upper strand 7 to the lower bonding drum 28 is supported by a vacuum being applied thereto, which serves not just to suction off fluid that is dispensed from the first nozzle bar 29 for bonding.

A further embodiment is shown in FIG. 3 which again shows the system 100 in the first operating state. In order to avoid repetition, only the differences between the embodiment shown in FIG. 3 and that shown in FIG. 2 are described below.

Figure 3:
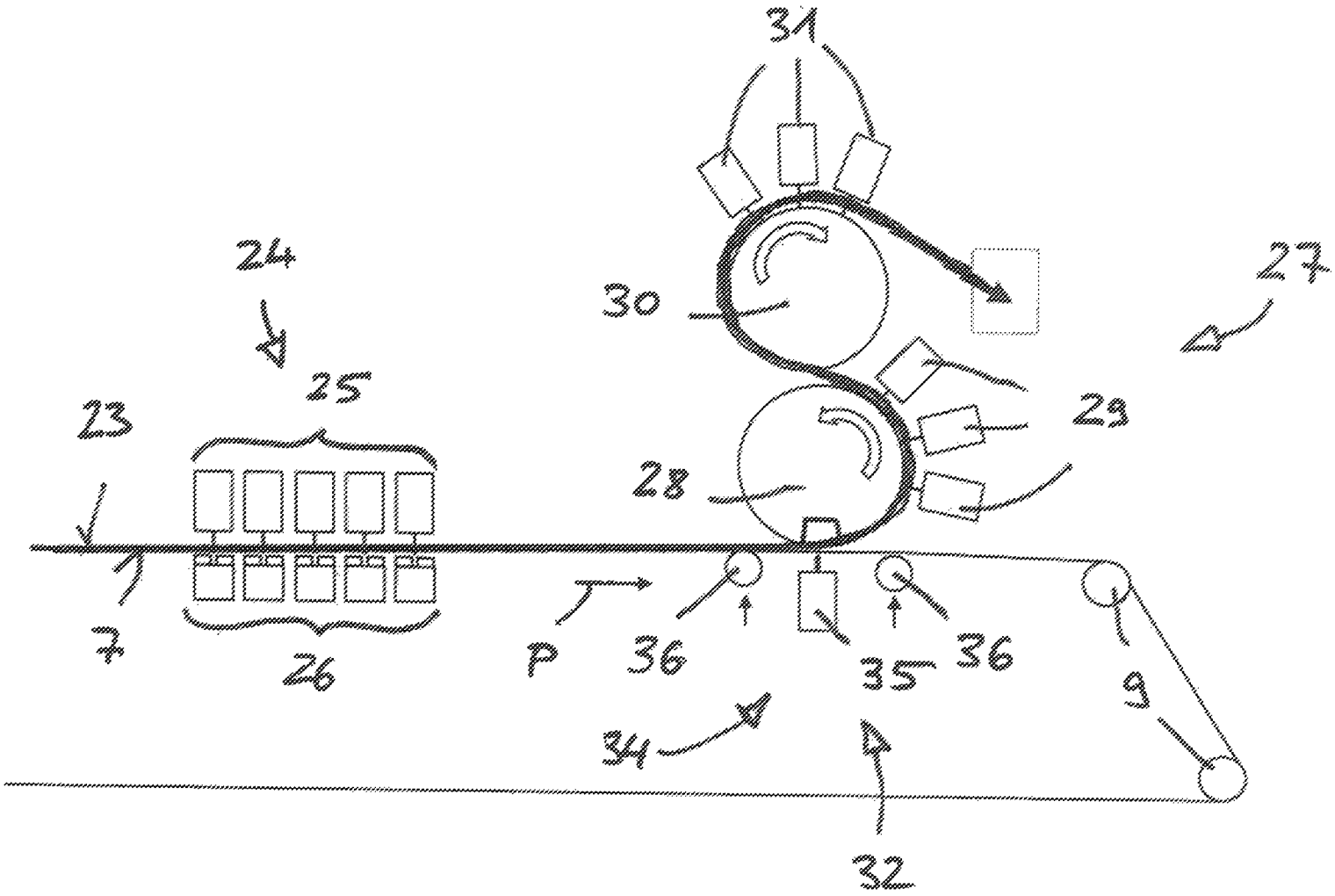
FIG. 3 shows a detail corresponding to FIG. 2 of a further embodiment of a system according to the present invention.

In the embodiment shown in FIG. 3, the lifting beams are replaced by lifting rollers 36. The transfer device 32 is therefore structurally more complex. Wear is nevertheless reduced due to the lower friction between the first belt 8 and parts of the transfer device 32.

Figure 4:
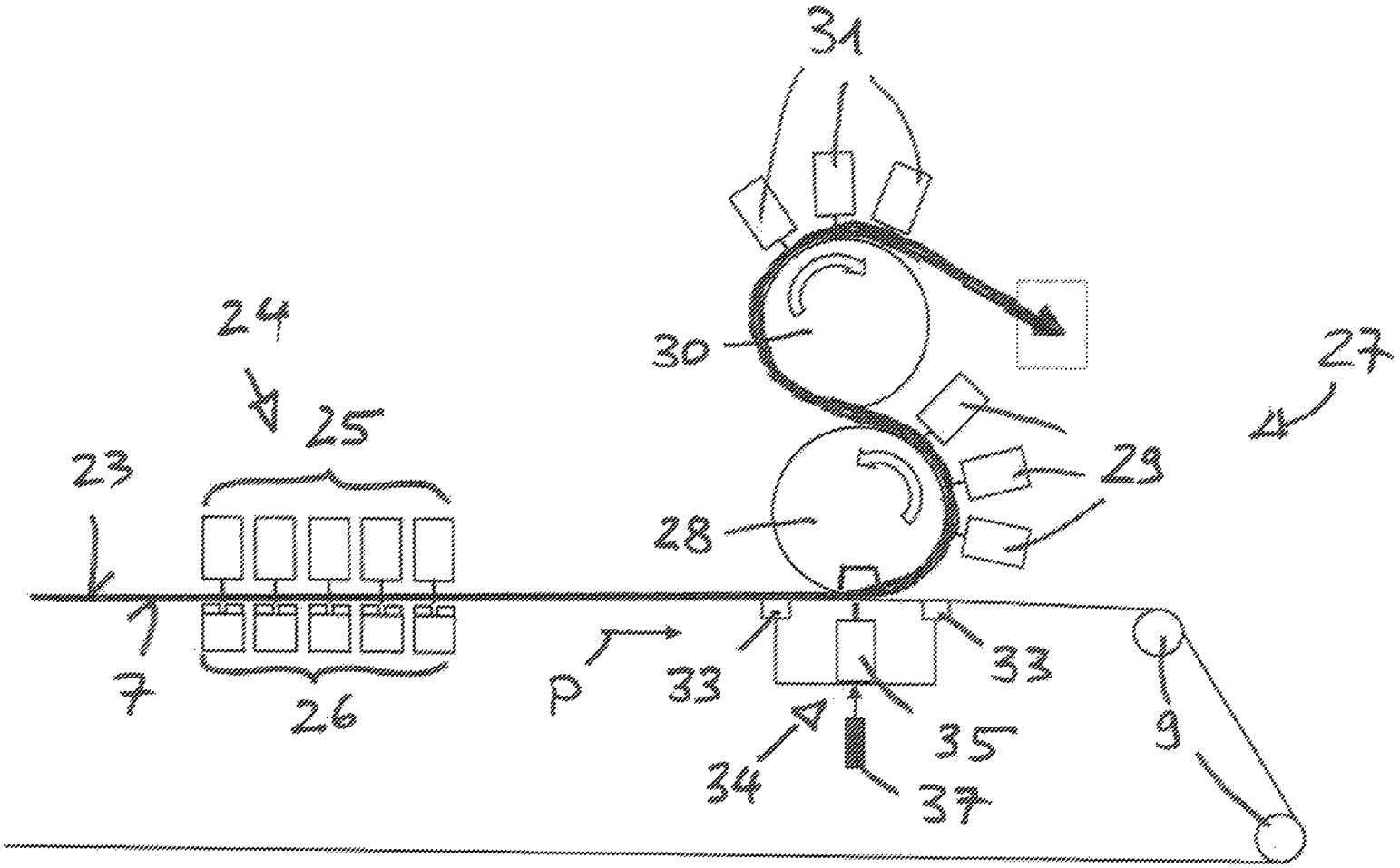
FIG. 4 shows a detail corresponding to FIG. 2 of a further embodiment of the system according to the present invention.

In the further embodiment illustrated in FIG. 4, the transfer device 32 again has two lifting beams 33. In contrast to the embodiment shown in FIG. 2, not only can the two lifting beams 33 be raised and lowered, they are also operatively connected to the fluid dispensing device 34 so that the transfer device 32 can be raised and lowered with the lifting beams 33. An actuator 37 is used for raising and lowering. The actuator 37 can, for example, be designed to be driven mechanically, electrically, hydraulically or pneumatically.

Figure 5:
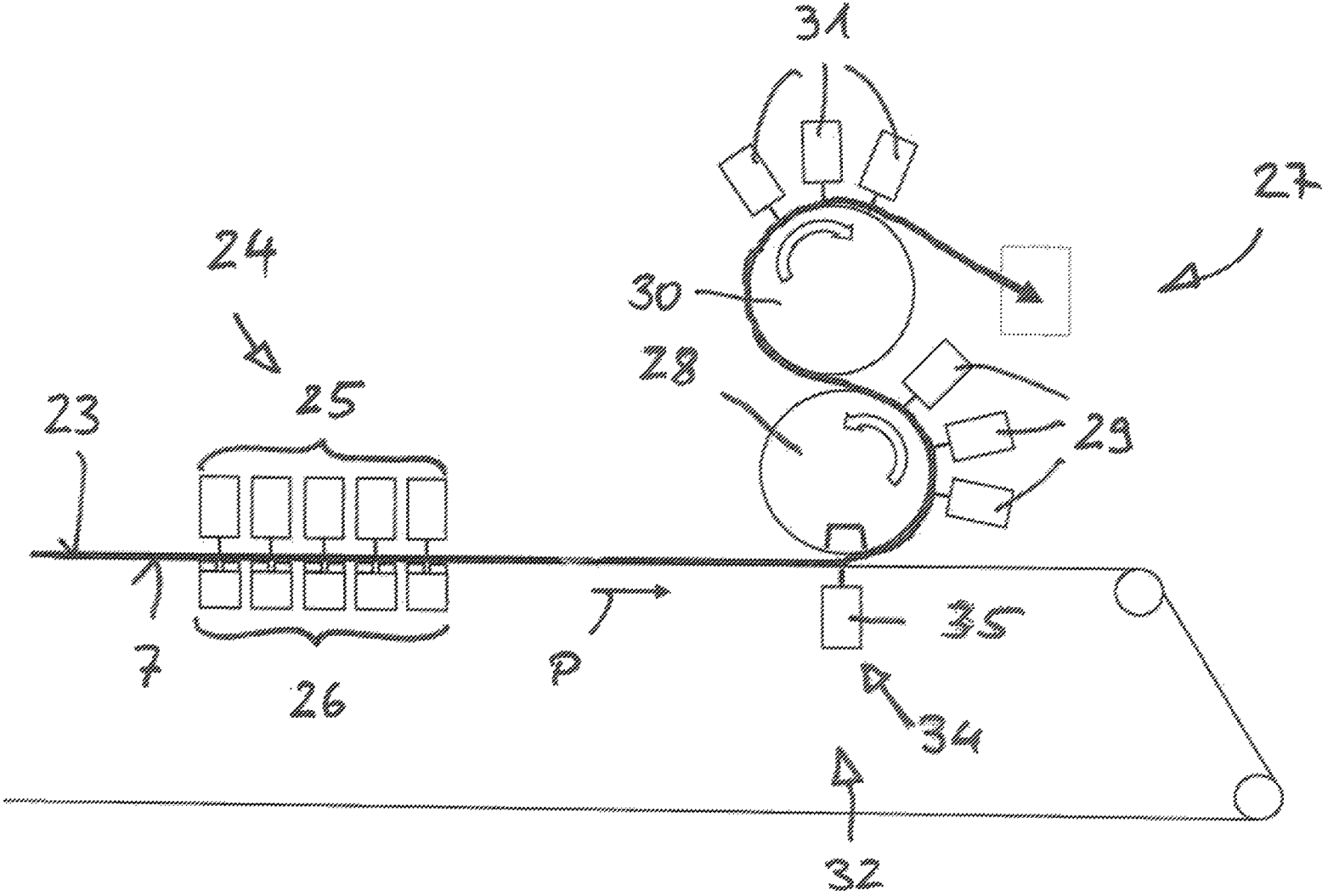
FIG. 5 shows a detail corresponding to FIG. 2 of a further embodiment of a system according to the present invention.

Another structurally simpler embodiment of a system 100 according to the present invention is shown in FIG. 5 in the first operating state. In contrast to the embodiments described above, the transfer device 32 in this case comprises only one fluid dispensing device 34 in the form of a nozzle bar 35 via which a fluid (that is optionally under an overpressure) can be dispensed upward toward the first belt 8 so that the fiber layer 23 can be transferred to the lower bonding drum 28 exclusively due to the effect of the fluid.

Figure 6:
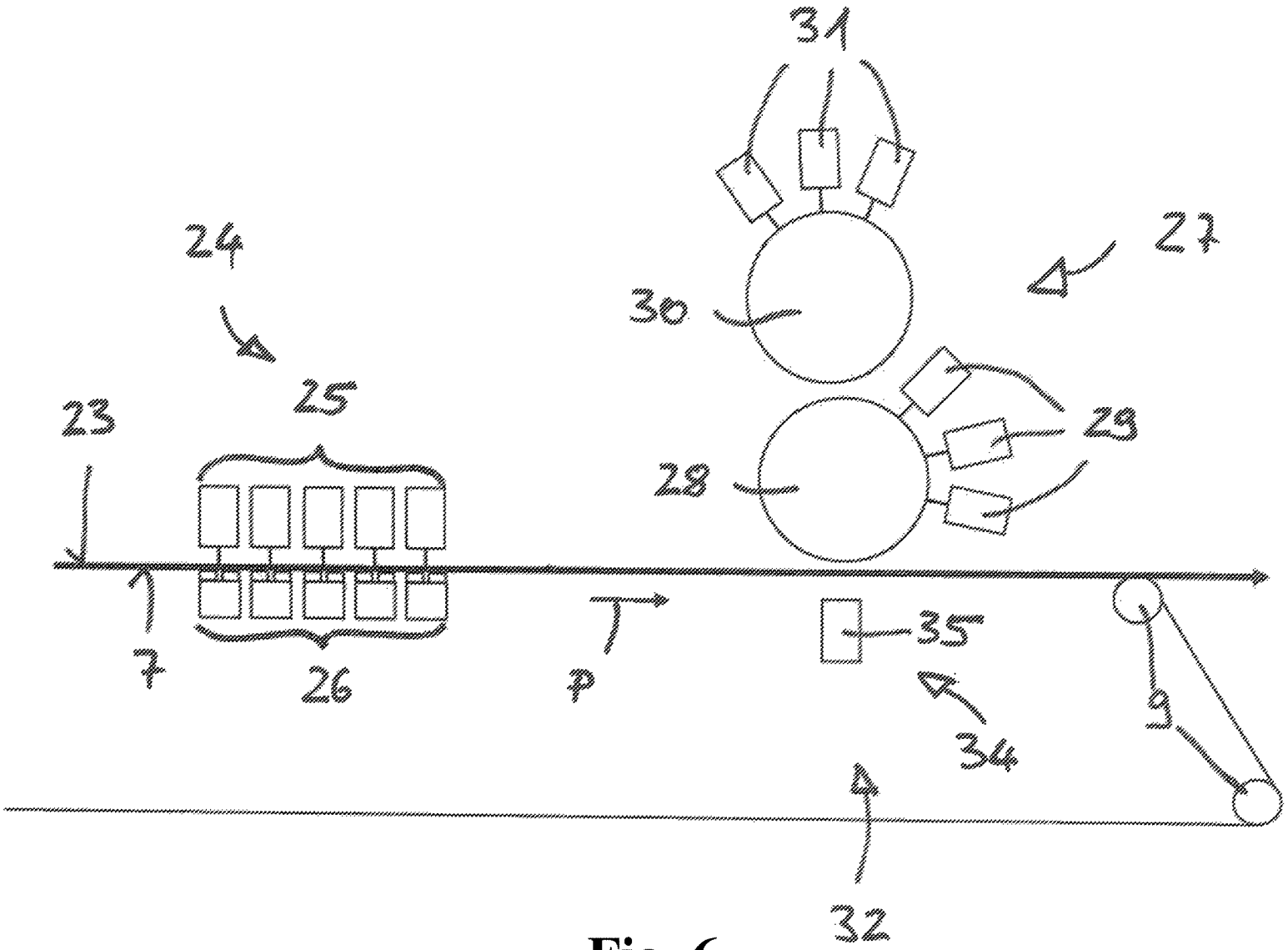
FIG. 6 shows the same embodiment of the system according to the present invention as in FIG. 5, but in a second operating state.

If the transfer device 32 is put out of operation, as is shown in FIG. 6 using the example of the embodiment shown in FIG. 5, there is no longer a transition from the upper strand 7 of the first belt 8 to the second bonding device 27. In this second operating state, the fiber layer 23 is no longer subjected to the second bonding step, but is guided past the second bonding device 27 at the upper strand 7. This results in a significantly less bonded nonwoven web, which is particularly suitable for forming flushable wipes. Nonwoven webs of this type regularly comprise only a small proportion of or no long fibers, so that the system according to the present invention in this operating state is also particularly suitable for the production of flow webs which only comprise a layer 13 comprising short fibers. It goes without saying that a plurality of headboxes 17 can be provided via which different short fibers can then be deposited on the second belt 14, and thus the layer 13 can contain a plurality of layers of short fibers or a mixture of different short fibers.

The present invention is not limited to embodiments described herein; reference should be had to the appended claims.

LIST OF REFERENCE NUMERALS

100 System
1 Carding unit
2 Deposit belt
3 Upper strand
4 Long fibers
5 Layer
6 Suction roller
7 Upper strand
8 First belt
9 Roller
11 Device
12 Short fibers
13 Layer
14 Second belt
15 Roller
16 Region
17 Headbox
18 Region
19 Region
20 Lower strand
21 Lower roller
22 Pre-bonding unit
23 Fiber layer
24 First bonding device
25 Nozzle bar
26 Suction chambers
27 Second bonding device
28 Lower bonding drum
29 First nozzle bar
30 Upper bonding drum
31 Second nozzle bar
32 Transfer device
33 Lifting beam
34 Fluid dispensing device
35 Nozzle bar
36 Lifting roller
37 Actuator
P Production direction

What is claimed is:

1. A system for bonding at least one wet-laid or dry-laid fiber layer to form a nonwoven web, the system comprising:

a conveyor comprising a circulating belt which comprises an upper strand which is configured so that the at least one wet-laid or dry-laid fiber layer is deposited and displaced on the upper strand in a production direction;

a first bonding device which is configured to bond the at least one wet-laid or dry-laid fiber layer when on the upper strand;

a second bonding device which is configured so that the at least one wet-laid or dry-laid fiber layer is bonded after leaving the upper strand; and a transfer device which is configured to feed the at least one wet-laid or dry-laid fiber layer to the second bonding device, wherein, the system can be operated in a first operating state in which the at least one wet-laid or dry-laid fiber layer only passes through the first bonding device and, after leaving the upper strand of the conveyor, can be fed to further production steps, bypassing the second bonding device, and a second operating state, in which the at least one wet-laid or dry-laid fiber layer is fed from the upper strand to the second bonding device and can be fed therefrom to the further production steps.

2. The system as recited in claim 1, wherein the circulating belt is further configured to be fluid-permeable.

3. The system as recited in claim 1, wherein the second bonding device comprises a bonding drum which is arranged above the upper strand.

4. The system as recited in claim 3, wherein the transfer device comprises a fluid dispensing device which is arranged below the upper strand, the fluid dispensing device being configured so that a fluid is slidable from below through the upper strand and from below against at least one wet-laid or dry-laid fiber layer so that the at least one wet-laid or dry-laid fiber layer is conveyed to the bonding drum under an action of the fluid.

5. The system as recited in claim 4, wherein the fluid dispensing device comprises a nozzle bar which comprises a plurality of nozzles which are configured to dispense the fluid via an overpressure.

6. The system as recited in claim 4, wherein the transfer device further comprises at least one lifting device which is configured to raise the upper strand in a region of the second bonding device.

7. The system as recited in claim 6, wherein the at least one lifting device comprises at least one of at least one lifting roller and at least one lifting beam.

8. The system as recited in claim 7, wherein the at least one of the at least one lifting roller and the at least one lifting beam comprises/comprise a friction-reducing plastics cap or a friction-reducing coating.

9. The system as recited in claim 7, wherein the at least one of the at least one lifting roller and the at least one lifting beam is/are arranged in the production direction upstream of the fluid dispensing device and the at least one of the at least one lifting roller and the at least one lifting beam is/are arranged downstream of the fluid dispensing device.

10. The system as recited in claim 4, wherein the transfer device further comprises at least two lifting devices which are operatively connected to the fluid dispensing device so that each of the at least two lifting devices can be raised and lowered synchronously.

11. The system as recited in claim 6, further comprising:

an actuator which is configured to operate mechanically, electrically, pneumatically or hydraulically, wherein, at least one of the at least one lifting device and the fluid dispensing device is/are configured to be motorically raised and lowered via the actuator.

* * * * *